United States Patent [19]

Bantien et al.

[11] 4,061,234

[45] Dec. 6, 1977

[54] APPARATUS FOR ASSEMBLING MULTI-LAYER GROUPS OF CIGARETTES OR THE LIKE

[75] Inventors: Jürgen Bantien; Dietrich Bardenhagen; Johannes Mielke; Friedel Kruse, all of Hamburg, Germany

[73] Assignee: Hauni-Werke Körber & Co., KG, Hamburg, Germany

[21] Appl. No.: 508,392

[22] Filed: Sept. 23, 1974

[30] Foreign Application Priority Data

Sept. 22, 1973 Germany ..... 2347781

[51] Int. Cl.[2] ..... B65B 19/10

[52] U.S. Cl. ..... 214/6 M; 53/149; 198/420; 198/616; 214/6 N

[58] Field of Search ..... 214/6 N, 6 M, 6.5; 53/148, 149, 150, 151, 152; 198/20 C, 24, 53 R, 59, 419, 420, 616; 131/25

[56] References Cited

U.S. PATENT DOCUMENTS

| | | | |
|---|---|---|---|
| 1,539,745 | 5/1925 | Kerlin et al. | 53/149 X |
| 1,765,820 | 6/1930 | Bronander et al. | 53/151 |
| 1,847,060 | 2/1932 | Bronander | 53/151 X |
| 1,961,047 | 5/1934 | Horgan | 53/149 |
| 2,334,142 | 11/1943 | Arelt | 53/149 |
| 2,682,983 | 7/1954 | Ashcroft | 53/151 |
| 3,590,556 | 7/1971 | Focke | 53/151 X |

*Primary Examiner*—L. J. Paperner

*Attorney, Agent, or Firm*—Peter K. Kontler; John Kurucz

[57] ABSTRACT

Apparatus for assembling blocks of parallel cigarettes in formations ready for packing has a magazine for a supply of parallel cigarettes and three groups of downwardly extending ducts whose upper ends communicate with the magazine to admit parallel cigarettes and whose lower end portions are located at a block building station. The end portions of the two outer groups of ducts are located in horizontal planes, one above the other, and the end portion of each duct of one outer group registers with the end portion of a duct of the other outer group. The end portions of the median group of ducts are vertical or nearly vertical and are located between the end portions of the two outer groups of ducts. The rows of parallel cigarettes which accumulate in the end portions of the ducts are expelled simultaneously by a pusher whereby the expelled cigarettes pass through a mouthpiece which completes their conversion into a block. The cigarettes descend in the ducts by gravity and owing to the weight of cigarettes in the magazine. Since the block building station receives cigarettes from more than two discrete groups of ducts, the accumulation of rows which can be converted into a block takes up a short interval of time.

12 Claims, 4 Drawing Figures

APPARATUS FOR ASSEMBLING MULTI-LAYER GROUPS OF CIGARETTES OR THE LIKE

BACKGROUND OF THE INVENTION

The present invention relates to apparatus for assembling or building blocks of parallel rod-shaped articles, particularly rod-shaped articles which contain tobacco and are ready to be introduced into a packing machine or into another processing machine for smokers' products. Still more particularly, the invention relates to improvements in apparatus for assembling multi-layer blocks or arrays of plain or filter-tipped cigarettes, cigars or cigarillos.

It is known to connect the magazine at the inlet of a cigarette packing machine with two groups of downwardly extending ducts which convey cigarettes sideways to a block forming station. Each duct of one group communicates with a duct of the other group at the block forming station and those end portions of the ducts which are located at such station are horizontal and disposed one above the other. A pusher is caused to perform periodic working strokes in the axial direction of cigarettes which accumulate at the block forming station to expel a block of cigarettes into the pocket of an indexible turret or an analogous conveyor for blocks of cigarettes. Since the cigarettes descent in their ducts by gravity, the frequency at which a block can be expelled by the pusher depends on the length of intervals which are needed to allow for refilling of the end portions of ducts at the block building station with fresh cigarettes subsequent to retraction of the pusher. Attempts to accelerate the filling of ducts at the block forming station include the provision of a greatly increased number of pairs of communicating ducts, e.g., one pair for each cigarette of a layer of cigarettes in a block. Such mode of assembling blocks is satisfactory when a block comprises a substantial number of layers, e.g., three layers of seven cigarettes each or two layers of seven cigarettes each and an intermediate layer of six cigarettes. However, the operation of such apparatus is unsatisfactory when the number of layers is small (e.g., two) and each layer consists of a large number of cigarettes (e.g., ten). The walls of neighboring ducts then occupy so much space that the conversion of cigarettes which fill the block forming station into a block of ultimate size and shape necessitates substantial lateral movement of all or nearly all cigarettes during expulsion from the block forming station. The situation is aggravated by the fact that the width of each duct must exceed the diameter of a cigarette in order to avoid jamming and the resulting lengthy interruptions in operation of block forming apparatus.

SUMMARY OF THE INVENTION

An object of the invention is to provide a novel and improved apparatus for assembling multi-layer blocks or arrays of cigarettes or analogous rod-shaped articles in such a way that the assembly of a block takes up less time than in heretofore known apparatus.

Another object of the invention is to provide an apparatus which can assemble blocks consisting of predetermined numbers of cigarettes or analogous rod-shaped articles within short intervals of time in spite of the fact that its block building station receives articles which advance by gravity and in spite of the fact that the number of ducts which feed articles from the magazine to the block building station need not equal the number of articles in a layer.

A further object of the invention is to provide an apparatus which occupies little room, which can be installed in presently known production lines for rod-shaped smokers' products, and which is less likely to cause jamming of articles during travel toward the block building station than heretofore known apparatus.

An additional object of the invention is to provide an apparatus which can assemble blocks of cigarettes or the like at frequent intervals and wherein the aritcles are treated gently so that they are not likely to be deformed or otherwise damaged during travel toward and/or during expulsion pulsion from the block building station.

Still another object of the invention is to provide an apparatus wherein the dimension and/or the configuration of a block which is assembled at the block building station need not appreciably exceed or differ from the dimensions and/or configuration of the block as it appears immediately prior to wrapping or packing.

A further object of the invention is to provide an apparatus for assembling blocks of cigarettes or analogous rod-shaped articles which contributes to a higher output of packing machines for rod-shaped smokers' products.

The invention is embodied in an apparatus for assembling multi-layer blocks consisting of predetermined numbers (e.g., twenty or twenty-one) of cigarettes or analogous rod-shaped articles, particularly for arraying rod-shaped articles in the form of blocks which are ready for packing. The apparatus comprises a magazine, a bin or an analogous source which contains a supply of parallel rod-shaped articles, and first and second article feeding means respectively including a first and a second group of elongated ducts having inlets communicating with the magazine and end portions which are remote from and are located at a level below the respective inlets so that each duct slopes downwardly, at least in part, intermediate its inlet and its end portion to allow the articles of the supply of articles in the magazine to descend in the ducts by moving sideways and to form in the respective end portions rows of parallel articles. The end portions of the first group of ducts are spaced apart from the end portions of ducts of the second group and, in accordance with a feature of the invention, the apparatus further comprises third article feeding means including at least one additional duct (preferably two or more additional ducts) having an inlet communicating with the magazine and an end portion located at a level below the respective inlet and disposed between the end portions of the first and second groups of ducts so that the articles which enter the inlet of the additional duct and descent therein by moving sideways form in the end portion of the additional duct an additional row of parallel articles which row is preferably inclined with respect to the rows of articles in the end portions of the first and second groups of ducts. The apparatus further comprises a pusher or analogous means for simultaneously expelling the rows of articles from all of the end portions at such intervals that the end portions are refilled with rows of articles between successive working strokes of the expelling means. The simultaneously expelled rows form a block which can be caused to pass through a suitable mouthpiece in order to move the articles nearer to each other and to thus complete the formation of a compacted block which is ready for introduction into a packing machine.

The end portions of the first and second groups of ducts are preferably horizontal, and the end portion of each duct of the first group is preferably aligned with the end portion of a duct of the second group. The additional duct or ducts may be vertical or nearly vertical and their end portions preferably close the open ends of the end portions of the first and second groups of ducts. All of the end portions are preferably located in a common vertical plane, i.e., the end portions of the first group of ducts may be located one above the other, the end portions of the second group of ducts may also be located one above the other, and the end portions of the additional ducts may be disposed side-by-side between the end portions of the first and second groups of ducts.

The third feeding means may comprise one or more discrete groups of additional ducts or a single group of additional ducts. The block building station is defined by the end portions of all of the ducts.

The novel features which are considered as characteristic of the invention are set forth in particular in the appended claims. The improved block assembling apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
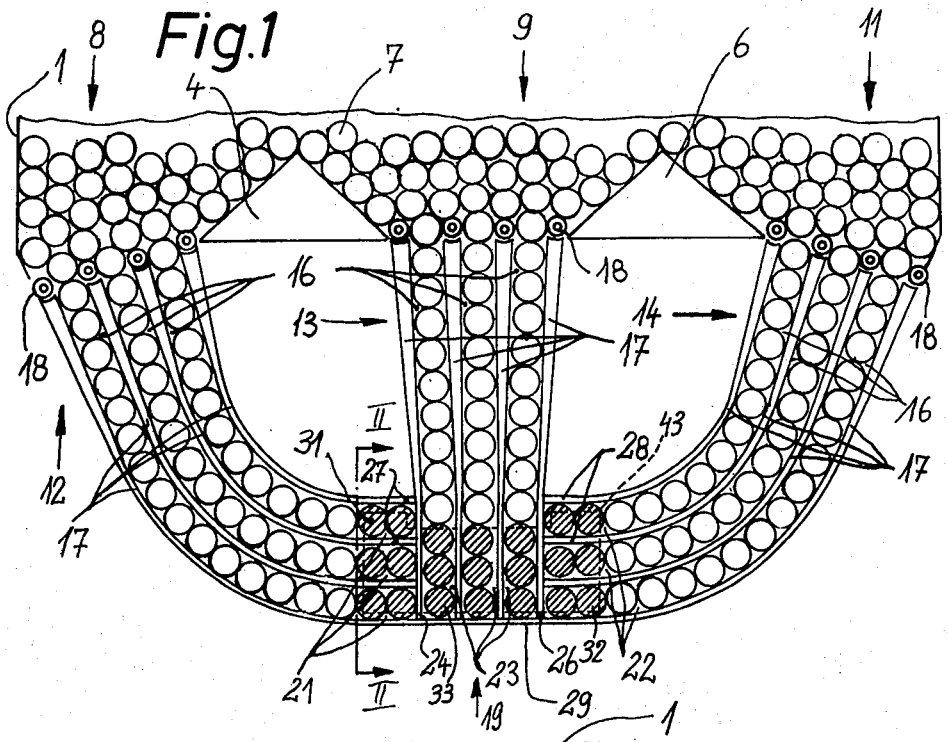
FIG. 1 is a fragmentary longitudinal vertical sectional view of an apparatus which embodies one form of the invention and which is utilized to assemble three-layer blocks of twenty-one cigarettes each.
Figure 2:
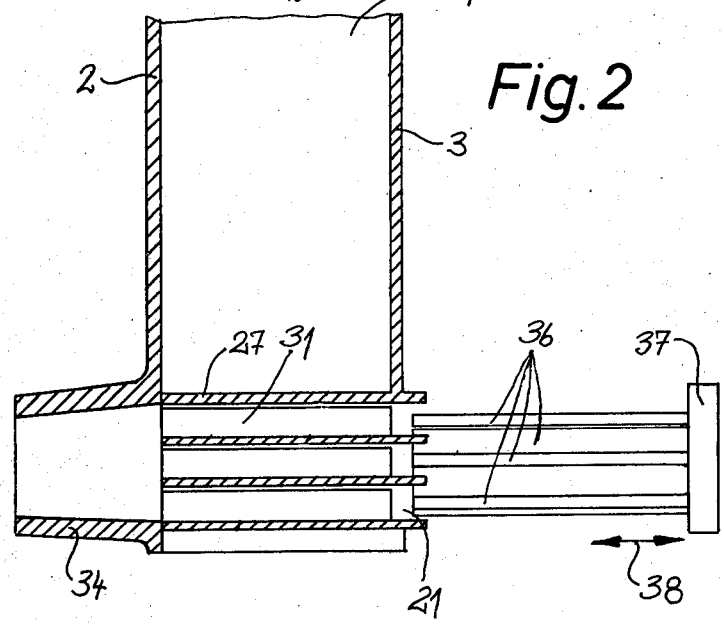
FIG. 2 is a fragmentary transverse vertical sectional view as seen in the direction of arrows from the line II—II of FIG. 1.

The block assembling or forming apparatus of FIGS. 1 and 2 comprises a magazine or bin 1 which contains a supply of parallel rod-shaped articles 7, e.g., plain or filter-tipped cigarettes. The magazine comprises spaced-apart upright front and rear walls 2, 3 which may but need not extend all the way down to a block forming or building station 19. FIG. 1 merely shows the lower part of the magazine 1; this lower part contains two triangular baffles 4 and 6 which subdivide the respctive portion of the interior of the magazine into three compartments 8, 9 and 11. The baffles 4 and 6 can but need not extend all the way across the interior of the magazine 1, i.e., all the way from the front wall 2 to the rear wall 3.

The lower part of the compartment 8 communicates with the inlets of three elongated ducts 16 which form a first group 12, and the lower part of the compartment 11 communicates with the inlets of three elongated ducts 16 which form a second group 14. The ducts 16 of the group 12 are mirror symmetrical to the ducts 16 of the group 14 with reference to a vertical plane which is normal to the plane of FIG. 1 and halves the median eompartment 9. The lower part of the compartment 9 communicates with the inlets of three additional ducts 16 which form a third or additional group 13 and are vertical or nearly vertical. The lower end portions 21 and 22 of the ducts 16 of the first and second groups 12 and 14 are horizontal and are disposed one above the other. The right-hand ends of the lower end portions 21 and the left-hand ends of the lower end portions 22 are open, and each end portion 21 is aligned with one of the end portions 22. The lower end portions 23 of the ducts 16 forming the additional group 13 extend into the space between the end portions 21 and 22. The walls of the ducts 16 are shown at 17. It will be seen that the lower end portions 24 of the left-hand wall 17 of the leftmost duct 16 of the group 13 closes the open ends of the end portions 21 and that the lower end portion 26 of the right-hand wall 17 of the rightmost duct 16 of the group 13 closes the open ends of the end portions 22. The walls 17 of the ducts 16 of the groups 12 and 14 slope downwardly and the cigarettes 7 which enter these ducts (as well as the vertical ducts of group 13) descend therein by moving sideways. The thickness of the walls 17 preferably decreases in a direction toward the block building station 19 which is formed by the end portions 21–23 of the ducts 16 and which can accumulate a block 43 consisting of twenty-one cigarettes 7 forming three horizontal layers. Each end portion 21 contains a horizontal row 31 of two parallel cigarettes 7, each end portion 22 contains a horizontal row 32 of two parallel cigarettes 7, and each end portion 23 contains a vertical row 33 of three parallel cigarettes. Thus, the rows 33 are inclined with respect to the rows 31, 32 and the rows 31, 32 flank the rows 33. The lower end portions of the walls 17 of all of the ducts may consist of thin sheet metal to thus reduce the spacing between the rows 31, 32 or 33. The lower ends of the end portions 23 are closed by a base plate 29 which may but need not be integral with the wall portions boundimg the undersides of the two lowermost end portions 21, 22.

The upper end face of each wall 17 is adjacent to a preferably driven agitating roller 18. The means for rotating these rollers is preferably designed to turn them back and forth to thus reduce the likelihood of bridging of cigarettes at the inlets of the ducts 17 and the likelihood of misalignment of cigarettes in the compartments 8, 9, 11, as well as to promote the entry of cigarettes into the ducts 16 wherein the cigarettes move sideways and enter the respective end portions 21, 22, 23 to form the rows 31, 32, 33. The thickness of the upper end portions of the walls 16 preferably equals or approximates the diameters of the agitating rollers 18. The axes of the rollers 18 are parallel to the axes of cigarettes 7 in the magazine 1 and in the ducts 16. It is preferred to use agitating rollers having grooved or ribbed peripheral surfaces whereby the grooves or ribs extend in the longitudinal direction of cigarettes 7.

The curvature of each duct 16 of the groups 12 and 14 is preferably gradual and sufficiently pronounced to allow the cigarettes 7 to travel rapidly toward the block forming station 19 without any misalignment and within a short period of time. The height of a row 33 is less than the combined height of the rows 31 because the rows 31 are separated from each other by the relatively thin lower end portions 27 of walls 17 of the ducts 16 of group 12. This also applies for the height of the rows 33 and the combined height of the rows 32 (see the end portions 28 of the walls 17 of ducts 16 forming the group 14).

The front wall 2 of the magazine 1 is formed with an outwardly extending nipple or mouthpiece 34 which registers with the station 19, whose cross-sectional area decreases gradually in a direction away from the rear wall 3, and which communicates with the end portions 21–23 of the ducts 16. The means for expelling blocks 43 of twenty-one cigarettes 7 each from the block forming station 19 comprises a transfer member or pusher 37 which is normally located behind the rear wall 3 and is movable in directions indicated by a double-headed arrow 38. The pusher 37 has nine projections or fingers 36 which can enter the station 19 by passing through openings in the rear wall 3 and each of which can transfer a row 31, 32 or 33 from the respective end portion 21, 22 or 23 into the mouthpiece 34. Once the rows 31–33 enter the mouthpiece 34, they are converted into a final or finished block wherein each of the three layers contains seven closely adjacent cigarettes 7 and wherein each cigarette of the medial layer is located exactly between a cigarette of the upper layer and a cigarette of the lower layer. The minimum cross-sectional area of the passage which is defined by the mouthpiece 34 is selected with a view to compact the block 43 to such an extent that the block can be readily introduced into the pocket of a turret forming part of a cigarette packing machine, into a hollow mandrel in a packing machine, or directly into a partially finished soft or flip-flop pack. For the sake of clarity, the cigarettes 7 which form the rows 31, 32 and 33 at the station 19 of FIG. 1 are identified by hatching.

The maximum frequency at which the pusher 37 can perform working strokes (in a direction to the left, as viewed in FIG. 2) is determined by the length of a first interval which is required to withdraw the fingers 36 from the station 19 plus the length of a second interval which is required to allow for renewed filling of the station 19 with rows 31–33 which together form a block 43 of twenty-one cigarettes. It has been found that the length of the second interval can be reduced considerably by the provision of ducts 16 which form the additional groups 13, i.e., by placing additional ducts between those ducts (or groups 12 and 14) whose lower end portions are horizontal. This is due to the fact that the improved apparatus enables the cigarettes 7 to enter the block building station 19 from three different directions.

It is clear that the additional group 13 may comprise a single duct 16, two ducts or more than three ducts, and that the ducts of the group 13 may be assembled into two or more subgroups. Also, the walls 2 and 3 need not close the ends of ducts 16 between the lower ends of the compartments 8, 9, 11 and the block forming station 19. The mouthpiece 34 may constitute a discrete part which is mounted in register with the front side of the station 19.

The lowermost cigarettes 7 of the vertical rows 33 are located in a common horizontal plane with the cigarettes 7 of the lowermost rows 31 and 32.

Figure 3:
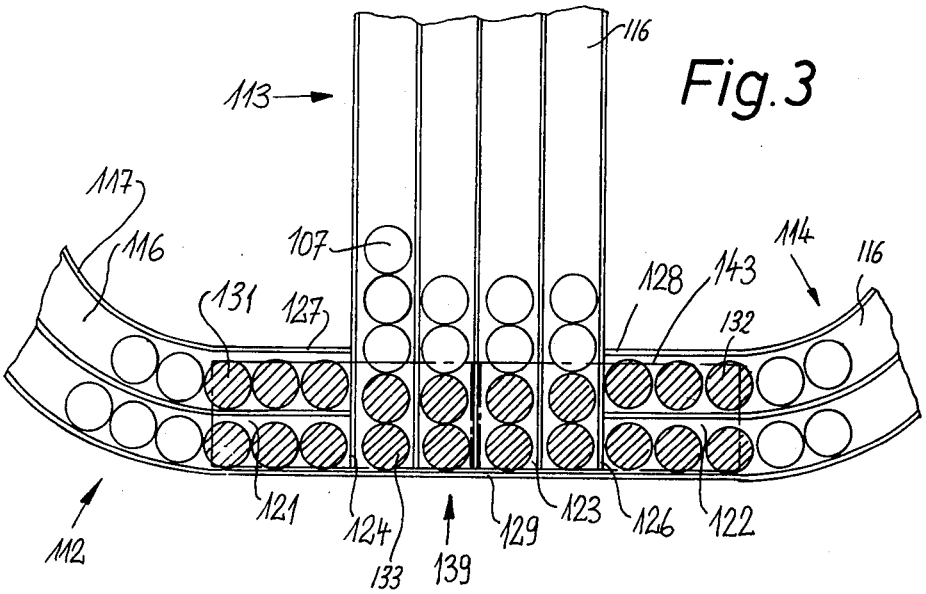
FIG. 3 is a fragmentary longitudinal vertical sectional view of a second apparatus which serves to assemble two-layer blocks of twenty cigarettes each.

FIG. 3 shows a portion of a second apparatus wherein all such parts which are identical with or clearly analogous to the corresponding parts of the first apparatus are denoted by similar reference characters plus 100. The compartments of the magazine (not shown) communicate with the inlets at the upper ends of ducts 116 which form a first group 112, a second group 114 which is mirror symmetrical to the group 112, and an additional group 113 which comprises four vertical ducts. Each of the groups 112, 114 comprises two ducts. Each of the two rows 131 of cigarettes 107 in the horizontal lower end portions 121 of the ducts 116 of the first group 112 consists of three parallel cigarettes, each row 132 in the end portion 122 of a duct 116 of the group 114 also consists of three parallel cigarettes 107, and each row 133 in the lower end portion 123 of a duct 116 of the group 113 consists of two cigarettes. The block 143 (indicated by broken lines) contains two layers of ten cigarettes each. Thus, the modified block building or forming station 139 of FIG. 3 is designed in such a way that it can receive eight rows of cigarettes 107 (therefore, the pusher which is used in the apparatus of FIG. 3 can have eight fingers) and the resulting block can fill a flat flip-top pack contaning twenty cigarettes 107 which form two layers.

It will be noted that the number of ducts 116 forming the group 112 again equals the number of ducts which form the group 114, but that this number is different from the number of ducts which form the additional group 113.

Figure 4:
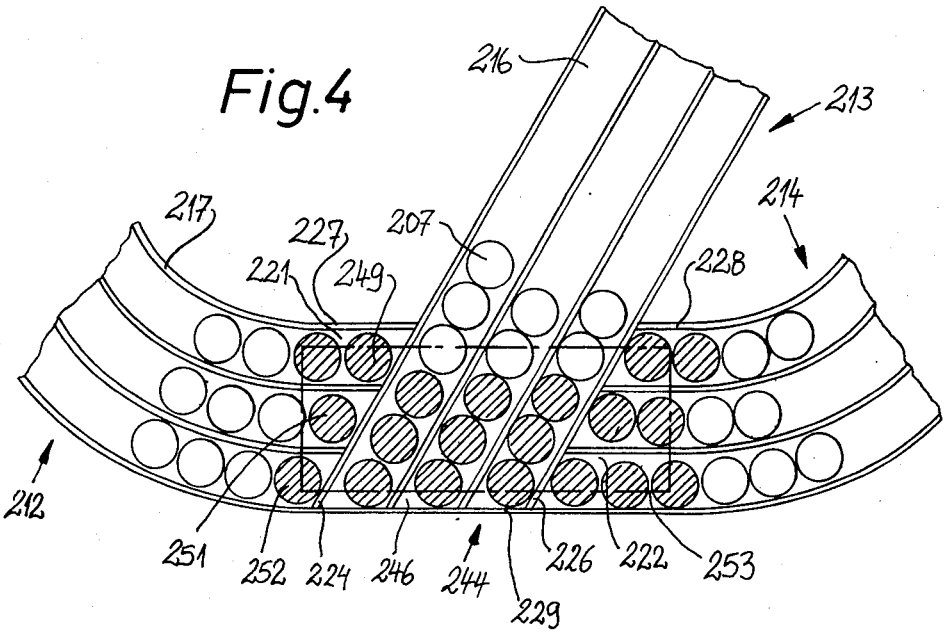
FIG. 4 is a fragmentary longitudinal vertical sectional view of a third apparatus which serves to assemble three-layer blocks of twenty cigarettes each.

The apparatus of FIG. 4 constitutes a second modification of the apparatus of FIGS. 1–2 and all such parts thereof which are identical with or clearly analogous to the corresponding parts of the first apparatus are denoted by similar reference characters plus 200. The lower end portions 246 of the ducts 216 which form the additional group 213 make an obtuse angle with the horizontal lower end portions 221, 222 of the ducts 216 which form the first and second groups 212, 214. This renders it possible to assemble at the station 244 a block 253 which contains a total pf twenty cigarettes 207 and which consists of three layers whereby the cigarettes of the block 243 are in the customary array having two outer layers 249, 252 of seven cigarettes each and a median layer 251 of six cigarettes. The cigarettes 207 of the median layer 251 are staggered with respect to the cigarettes of the two outer layers 249, 252.

It is clear that each of the three groups of ducts 16, 116 or 216 can receive rod-shaped articles from a discrete magazine or bin or that two of the three groups of ducts can receive cigarettes from a common source.

The lower end portions of ducts which form the additional group are vertical or nearly vertical (see FIGS. 1–2 or FIG. 3) when the apparartus is to assemble blocks wherein each layer contains the same number of articles. The utilization of additional ducts whose lower end portions are not normal to the end portions of the first and second groups of ducts renders it possible to assemble blocks wherein at least one of the layers contains a different number of articles.

An advantage of the improved apparatus is that the block forming station receives cigarettes or analogous rod-shaped articles (e.g., plain or filter-tipped cigars or cigarillos) which enter the lower end portions of the respective ducts by moving sideways in three different directions. Thus, the cigarettes 7, 107, 207 which travel in the ducts of the first group enter the block forming station by moving in a direction to the right, the cigarettes which descend in the ducts of the second grup enter the block forming station by moving in a direction to the left, and the cigarettes in the ducts of the additional group enter the block forming station by moving substantially or exactly vertically downwardly. This reduces the overall length of that interval which is needed to fill the block forming station with a requisite number of cigarettes. Moreover, the provision of one or more additional ducts renders it possible to assembly blocks containing any desired number of cigarettes and in any one of several presently preferred arrays. The improved apparatus has been found to be especially useful for the assembly of blocks (143) of the type shown in FIG. 3 wherein each of a relatively small number of layers (two) contains a relatively large number of cigarettes (ten). The assembly of such blocks in conventional apparatus is time-consuming and is likely to result in deformation of or other damage to the articles during expulsion from the block forming station. Rapid assembly of blocks is highly desirable when such blocks are to be introduced into a modern high-speed packing machine for cigarettes or the like because the operating speed of such machine is determined primarily by the frequency at which it can receive blocks of properly arrayed rod-shaped articles.

If desired, the articles which travel in the ducts toward the block forming station can be accelerated by resorting to suction and/or to a compressed gaseous fluid However, it has been found that the apparatus will operate quite satisfactorily, particularly as regards the frequency at which it assembles blocks of rod-shaped articles if the articles are allowed to descend by gravity and if the number of articles which are supplied by the ducts of the additional group at least equals but preferably exceeds the number of articles which are supplied by the ducts of the first or second group. As shown in FIG. 1, the group 13 delivers nine out of twenty-one cigarettes which form a block 43. In FIG. 3, the group 113 delivers eight out of twenty cigarettes 107. In FIG. 4, the group 213 delivers as many as nine out of twenty cigarettes 207.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therfore, such adaptations should and are intended to be comprehended within the meaning and range of equivalence of the claims.

What is claimed as new and desired to be protected by Letters Patent is set forth in the appended claims:

1. Apparatus for assembling multi-layer blocks consisting of predetermined numbers of cigarettes or analogous rod-shaped articles, particularly for arraying rod-shaped articles in the form of blocks which are ready for packing, comprising a magazine for a supply of parallel rod-shaped articles; first and second article feeding means respectively including a first and a second group of ducts having inlets communicating with said magazine and end portions remote from and located at a level below said inlets so that each of said ducts slopes downwardly, at least in part, intermediate said inlet and said end portion thereof to allow the articles of said supply to descend therein by moving sideways and to form in the respective end portion a row of adjacent parallel articles, said end portions of said first group of ducts being spaced apart from said end portions of said second group of ducts; and third article feeding means including at least one additional duct having an inlet communicating with said magazine and an end portion located at a level below said last mentioned inlet, the end portion of said additional duct being disposed between and being inclined with respect to the end portions of said first and second groups of ducts and the articles which enter the inlet of said additional duct and descend therein by moving sideways forming in said end portion of said additional duct an additional row of parallel articles; and means for expelling the rows of articles from said end portions at such intervals that said end portions are refilled with rows of articles between successive expulsions, said expelled rows forming a block or rod-shaped articles.

2. Apparatus as defined in claim 1, wherein the end portions of each of said first and second groups of ducts are substantially horizontal and are located one above the other.

3. Apparatus as defined in claim 2, wherein said third article feeding means comprises a plurality of additional ducts each having an inlet communicating with said magazine and an end portion located at a level below the respective inlet, the end portions of all of said additional ducts being located between the end portions of said first and second groups of ducts.

4. Apparatus as defined in claim 3, wherein all of said end portions are located in a common vertical plane so that the articles of the rows in said end portions are at least substantially aligned with each other.

5. Apparatus as defined in claim 3, wherein the end portion of each duct of said first group is aligned with the end portion of a duct of said second group.

6. Apparatus as defined in claim 3, wherein said end portions of said first and second groups of ducts have open ends and said additional ducts have walls which close said open ends.

7. Apparatus as defined in claim 6, wherein the ducts of said first and second groups have walls which abut against the walls of said additional ducts in the region of the open ends of the end portions of said first and second groups of ducts.

8. Apparatus as defined in claim 3, wherein the end portions of said additional ducts are substantially vertical.

9. Apparatus as defined in claim 3, wherein the end portions of said additional ducts make an oblique angle with the end portions of the ducts of said first and second groups.

10. Apparatus as defined in claim 3, wherein the number of ducts of said first group equals the number of ducts of said second group.

11. Apparatus as defined in claim 10, wherein the number of said additional ducts is different from the number of ducts of said first group.

12. Apparatus as defined in claim 2, wherein the lowermost article in the end portion of said additional duct is located in a common plane with the row of articles in the end portion of one duct of said first group and with the row of articles in the end portion of one duct of said second group.

* * * * *